US005207797A

United States Patent [19]

Yamate

[11] Patent Number: 5,207,797

[45] Date of Patent: May 4, 1993

[54] METHOD FOR PRODUCING DESIGNS AND IMAGE PATTERNS ON DENIM PRODUCTS

[76] Inventor: Masato Yamate, 612-2, Managura, Ekiya-cho, Fukuyama-shi, Hiroshima-ken, Japan

[21] Appl. No.: 559,538

[22] Filed: Jul. 23, 1990

Related U.S. Application Data

[62] Division of Ser. No. 257,669, Oct. 14, 1988, abandoned.

[30] Foreign Application Priority Data

Jan. 8, 1988 [JP] Japan ..... 63-2702
Jul. 13, 1988 [JP] Japan ..... 63-175578

[51] Int. Cl.[5] ..... D06L 3/08; B05D 3/12; B05D 5/00

[52] U.S. Cl. ..... 8/108.1; 427/242; 427/282

[58] Field of Search ..... 8/102, 108.1; 427/242, 427/282

[56] References Cited

U.S. PATENT DOCUMENTS 551,530 12/1895 Doebrich ..... 106/157 X
2,046,382 7/1936 Hirschkind ..... 8/108.1
2,089,063 8/1937 Johnson ..... 106/157
4,439,124 3/1984 Watanabe ..... 425/112

FOREIGN PATENT DOCUMENTS 0275432 7/1988 European Pat. Off. ..... 8/108.1

OTHER PUBLICATIONS

Hawley, G. G., "The Condensed Chemical Dictionary," 9th Ed., New York, Van Nostrand Reinhold Co., 1977, pp. 152, 460 and 513.

Hawley, G. G., "The Condensed Chemical Dictionary," New York, N.Y., Van Nostrand Reinhold Co., 1981, p. 28.

*Primary Examiner*—Evan Lawrence
*Attorney, Agent, or Firm*—McAulay Fisher Nissen Goldberg & Kiel

[57] ABSTRACT

A method for producing design patterns on denim products is disclosed wherein a predetermined design is formed on the denim with a composition comprising a paste form from albumen and deutoplasm. The denim product is dried and thereafter bleached. Upon washing of the bleached product to remove the paste, the desired pattern on the bleached product is obtained.

8 Claims, 1 Drawing Sheet

METHOD FOR PRODUCING DESIGNS AND IMAGE PATTERNS ON DENIM PRODUCTS

This application is a division of application Ser. No. 07/257,669, filed Oct. 14, 1988, now abandoned.

BACKGROUND OF THE INVENTION

Today, denim products have been much popular as pants, trousers and/or jackets. These denim products are made of thick cotton fabrics whose warps are dark blue and whose wefts are white and which are of diagonal weave or plain weave. There are generally two methods for producing design patterns on these denim products, one of which is a chemical washing method in which said denim products are put into a drum cage and a specified quantity of pumice which has been immersed and seasoned in an aqueous solution of calcium hypochlorite is put in said drum cage altogether and marble-like spotted design patterns can be produced by aid of rubbing and friction between said denim woven products and said pumice by rotating said denim woven products together said pumice in said rotary drum cage, and the other of which is called a chemical bleaching method in which said denim woven products are agitated for a specified period of time in an aqueous solution of calcium hypochlorite having a concentration of about 6%, thereby causing said denim woven products to be totally white-bleached.

In the former chemical washing method, the design is produced by only a number of irregular spots, and in the latter chemical bleaching method said denim woven products are only totally white-bleached. Namely in either case, produced design is merely vague. Therefore, these two conventional methods do not meet any requirements of recent youngsters who want that design pattern is novel, bold and individual and do not give us any designs of free drawing or painting.

SUMMARY OF THE INVENTION

The main object of the present invention is to provide a method by which not only simple marble-like spotted designs and another design that said denim woven products are only totally white-bleached but also bold, novel and individual designs can be freely produced in a simple manner.

DESCRIPTION OF THE PREFERRED EMBODIMENT

The present invention is a method for producing designs on denim products including denim materials and sewed products, such as, pants, trousers, and jackets, utilizing wax or a paste material. The paste material is produced by mixing and agitating the white of eggs (hereinafter merely called "albumen") and/or the yellow of eggs (hereinafter merely called "deutoplasm") and/or granulated shells of eggs (hereinafter merely called "shells") with paste. A design pattern is printed onto the denim with the paste. The denim products and/or denim materials with the design pattern thereon are put into a drum cage and at the same time, pumice stones (hereinafter merely called "pumices") which have been immersed and seasoned in an aqueous solution of calcium hypochlorite are put into the same drum cage and these denim products and denim materials are rotated together with pumices in said drum cage, as said drum cage rotates. At this time, the portions of the denim protected by the paste remain dark blue as compared to the unprotected areas which are contacted by the pumices. Said method further features mixing and agitating the deutoplasm and/or albumen and/or granulated shells with industrial alcohol together with wheat flour and water-soluble paint at the ratio of 5 to 20% by weight of said deutoplasm and/or albumen and/or granulated and/or powdered shells, thereby causing a paste agent to be produced. The paste agent is used for painting or drawing any desired designs at any position on the denim products including denim sewed products or denim cloth material. Thereafter, the paste agent is dried and further is dried after giving a coat of a glaze whose main constituent is albumen. The denim products and denim cloth materials are put into an aqueous solution of calcium hypochlorite at the ratio of 5 to 15% by weight of said aqueous solution, and said denim products and denim cloth materials are agitated for a specified period of time, thereby causing said design patterns to remain dark blue (or deep blue).

Example (1) Embodiments

A paste agent is produced by mixing and agitating albumen and wheat flour paste at the ratio of 1 to 0.5, and any desired design is drawn by using this paste agent by a paint brush on any part of any denim woven product (e.g. sewed jacket, pants, trousers and denim woven materials). Then, about twenty sets of pants, jackets or trousers are put in a drum cage and a specified quantity (about 40 kilograms) of pumice that has been immersed and seasoned in an aqueous solution of calcium hypochlorite is put in said drum cage. And said drum cage is rotated clockwise and counterclockwise (e.g. at a speed of 30 r.p.m.) for fifteen minutes. Under this condition, all the other part than the design parts drawn and painted with said paste agent by a paint brush is spotted like marble, but the part "m" drawn and painted with said paste agent can remain dark blue. A product (jacket) shown in FIG. 1 can be obtained.

Example (2) of Embodiments

Figure 1:
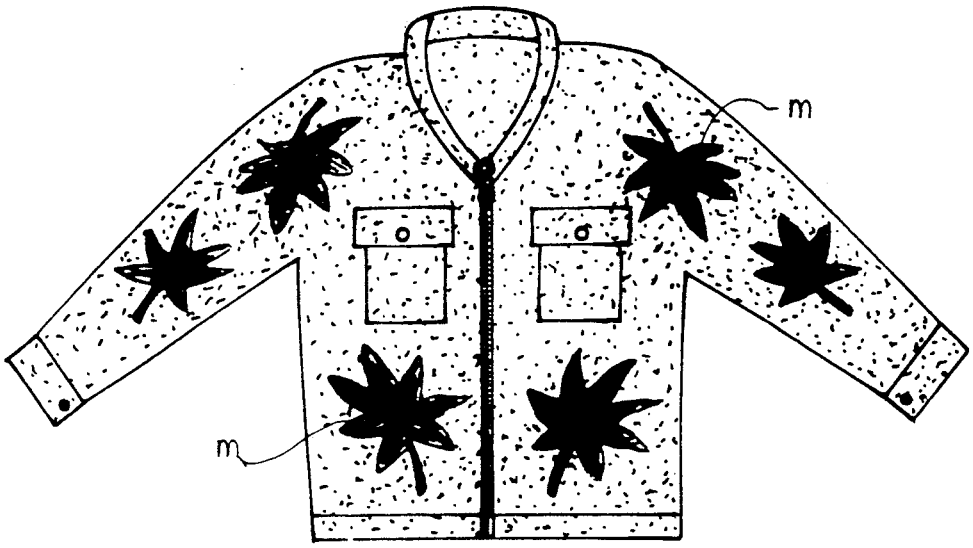
FIG. 1 is an front elevational view showing a denim woven product (a jacket) produced by a method disclosed by the prevent invention.

Another paste agent is produced by agitating and mixing deutoplasm (0.375), albumen (0.25), powder granulated shells (0.125) and wheat flour paste (0.25), at the ratio shown in the above brackets. Using this paste agent, any free and prompt design is drawn and painted on said denim woven product (e.g. a sewed jacket) by a paint brush. About twenty jackets are put in said drum cage and are rotated in the same manner as that shown in the example (1). Then, denim woven products shown in FIG. 1 can be obtained, on which the part drawn and painted with said paste agent can remain clearly dark blue as shown in FIG. 1.

Example (3) of Embodiments

Still another paste agent is produced agitating and mixing albumen and powder granulated shells together with wheat flour and water soluble paint (Blue) at the ratio of 9% in the weight percentage of said albumen and shells in industrial alcohol. Using this paste agent, any desired design "m" is drawn and painted on a denim woven material by a paint brush and said denim woven material is dried in a drying chamber for a specified period of time. After that, said denim woven material is taken out from said drying chamber and is further finished with a glaze (100% albumen) on said design. Then, said denim woven material is dried again.

Next, said dried denim woven material is put in an aqueous solution of 6% calcium hypochlorite and is agitated in it for about seven minutes. Finally, said denim woven material is take out from said water solution. The whole surface of said denim woven material is white-bleached but said design "m" can remain clearly dark blue. Namely, a product shown in FIG. 1 can be obtained.

Example (4) of Embodiments

Further another paste agent is produced by agitating and mixing deutoplasm and powder granulated shells with a prompt quantity of wheat flour in industrial alcohol in order to get a prompt hardness, adding water-soluble paint (Green) at the ratio of 10% of the total weight and agitating and mixing altogether. Any desired design is drawn with this paste agent on any prompt part of a jacket made of denim woven material by using a paint brush. Said jacket is dried for a specified period of time in a drying chamber. Then, said jacket is taken out, is furnished with a glaze whose contents is albumen by 95% and gelatine by 5% and is dried again.

Figure 2:
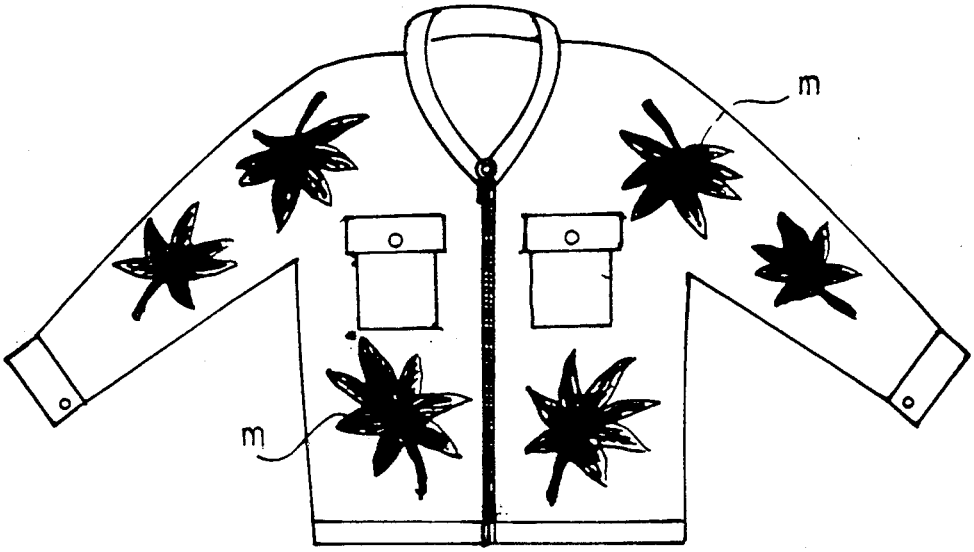
FIG. 2 is another front elevational view showing a denim woven products (also a jacket) produced by another method disclosed by the present invention.

Said jacket is put in an aqueous solution of 7% by weight calcium hypochlorite and is agitated in said solution for about ten minutes. In this case, the whole surface of said denim woven materials is white-bleached but said design "m" can remain clearly dark blue. Namely, a product shown in FIG. 2 can be obtained.

As described in the above four examples of embodiments, the method disclosed by the present invention can provide design denim products and materials which can best suit to the requirements and needs of recent youngsters, at a low cost, by drawing various kinds of novel, bold and individual designs on said denim products and materials including jackets, pants and other denim cloth materials in a simple manner.

Use of paste agents in the present invention is very convenient to provide variations of design, and such paste agents can be cheaply produced in a simple manner by agitating and mixing eggs with paste and/or together with powder granulated shells of eggs at a prompt ratio. By changing the mixing ratio thereof, paste agents of different hardness can be obtained, and novel and/or varied color design and/or patterns can be freely reproduced uniformly on denim products by selectively using said paste agents of different hardness and controlling the adhering amount thereof onto said denim products.

I claim:

1. A method for producing a design on a denim product comprising the steps of:

a) printing a pattern on the surface of a denim product with a paste for inhibiting bleaching, prepared by admixing wheat flour paste with a material selected from the group consisting of albumen, deutoplasm, granulated egg shells, and mixtures thereof;

b) drying the denim product from step a) to adhere the paste to the denim;

c) soaking pumice in an aqueous solution of calcium hypochlorite;

d) tumbling the pumice and denim having the paste adhered thereto for a predetermined time and tumbling speed; and e) removing the adhered paste by washing with water, whereby the area of the pattern covered by the paste remains unbleached and the uncovered portions are bleached.

2. The method of claim 1 wherein the paste is a homogeneous mixture of albumen and wheat flour paste.

3. The method of claim 1 wherein the paste comprises a homogeneous mixture of albumen, granulated egg shell, wheat flour paste, water-soluble paint and industrial alcohol.

4. The method of claim 1 wherein the paste is a homogeneous mixture of deutoplasm, granulated egg shell, wheat flour paste, water-soluble paint and industrial alcohol.

5. The method of claim 2 wherein the ratio of albumen to wheat flour paste is about 2:1.

6. The method of claim 3 wherein the composition of the paste on a weight basis is $\frac{3}{8}$ parts deutoplasm, $\frac{1}{4}$ album, $\frac{1}{8}$ granulated egg shell, and $\frac{1}{4}$ wheat flour paste.

7. A method for producing a design on a denim product comprising the steps of:

a) printing a pattern on the surface of a denim product with a paste for inhibiting bleaching, prepared by admixing a first mixture of albumen and granulated egg shell with a second mixture of wheat flour and water-soluble paint in industrial alcohol;

b) drying the denim product to adhere the paste thereto;

c) coating the adhered paste with a glaze consisting essentially of albumen;

d) drying the glazed denim from step c);

e) subjecting the denim product to bleaching in an aqueous solution of calcium hypochlorite; and f) washing the bleached product to remove the paste whereby the paste-covered portions remain unbleached and the uncovered portions of the denim product are bleached.

8. The method of claim 7 wherein the glaze on a weight basis comprises about 95 weight percent albumen and 5 weight percent gelatin.

* * * * *